US008434180B2

(12) United States Patent
Lee et al.

(10) Patent No.: US 8,434,180 B2
(45) Date of Patent: May 7, 2013

(54) WASHING MACHINE AND METHOD FOR CONTROLLING THE SAME

(75) Inventors: Sang Up Lee, Yongin-si (KR); Sung Jin Kim, Seongnam-si (KR); Sang Yeon Pyo, Suwon-si (KR); Hong Seok Ko, Yongin-si (KR); Jae Hong Kim, Suwon-si (KR); Myung Sun Kang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 448 days.

(21) Appl. No.: 12/656,985

(22) Filed: Feb. 22, 2010

(65) Prior Publication Data

US 2010/0269266 A1 Oct. 28, 2010

(30) Foreign Application Priority Data

Apr. 28, 2009 (KR) ..... 10-2009-0036945

(51) Int. Cl.
*D06F 33/00* (2006.01)
*D06F 31/00* (2006.01)

(52) U.S. Cl.
USPC ..... 8/159

(58) Field of Classification Search ..... 68/12.02, 68/12.16, 12.23, 3 R, 27; 8/158, 159
See application file for complete search history.

(56) References Cited

U.S. PATENT DOCUMENTS

| | | | | |
|---|---|---|---|---|
| 3,139,744 | A * | 7/1964 | Van Alstyne et al. | 68/20 |
| 3,161,481 | A * | 12/1964 | Edwards | 34/527 |
| 4,335,591 | A * | 6/1982 | Gillespie | 68/12.23 |
| 4,510,778 | A * | 4/1985 | Cotton | 68/12.15 |
| 7,621,012 | B2 * | 11/2009 | Kim | 8/147 |
| 8,015,646 | B2 * | 9/2011 | Lee et al. | 8/158 |
| 8,051,685 | B2 * | 11/2011 | Kim | 68/12.02 |
| 8,215,136 | B2 * | 7/2012 | Kim et al. | 68/27 |

FOREIGN PATENT DOCUMENTS

| | | | |
|---|---|---|---|
| CN | 101113557 | | 1/2008 |
| JP | 61-128795 | * | 6/1986 |
| JP | 63-127788 | * | 5/1988 |
| JP | 03-284284 | * | 12/1991 |
| KR | 2002-0076665 | | 10/2002 |
| KR | 10-2008-0010047 | | 1/2008 |

OTHER PUBLICATIONS

Chinese Office Action dated Nov. 27, 2012, from Chinese Patent Application No. 201010154614.7.

* cited by examiner

*Primary Examiner* — Joseph L Perrin
(74) *Attorney, Agent, or Firm* — Staas & Halsey LLP

(57) ABSTRACT

A washing machine and a control method thereof are disclosed. The washing machine has a plurality of washing tubs to clean laundry in different ways classified according to capacity and types of clothing. Different washing tubs simultaneously stop operations or are stopped at different times spaced apart from each other by a predetermined time, although washing tubs have different washing conditions (e.g., different input times of laundry, different amounts of laundry, different washing courses, etc.) when laundry is cleaned using the washing tubs.

13 Claims, 5 Drawing Sheets

WASHING MACHINE AND METHOD FOR CONTROLLING THE SAME

CROSS-REFERENCE TO RELATED APPLICATIONS

This application claims the benefit of Korean Patent Application No. 2009-0036945, filed on Apr. 28, 2009 in the Korean Intellectual Property Office, the disclosure of which is incorporated herein by reference.

BACKGROUND

1. Field

Embodiments of the present invention relate to a washing machine having a plurality of washing tubs to clean laundry in different ways classified according to capacity and types of clothing, and a method for controlling the same.

2. Description of the Related Art

Generally, a washing machine (i.e., a drum washing machine) includes a single washing tub, and separates pollutants or contaminants from dirty laundry using water and detergent. The washing machine washes or cleans the dirty laundry using a series of processes, i.e., a washing process for separating pollutants or contaminants from laundry using water containing a detergent, a rinsing process rinsing bubbles or residual detergent out of the laundry with clean water (specifically, rinsing water), and a dehydration process for dehydrating the laundry at high speed.

In recent times, a drying function has been added to the washing machine, so that the washing machine can perform a drying process for drying dehydrated laundry. However, because laundry generally has different types and different material qualities, the washing machine may have difficulty in simultaneously cleaning all the clothing contained in one washing tub using one washing course. The washing machine including one washing tub should separate some clothing, prohibited from being simultaneously cleaned, from other clothing capable of being simultaneously cleaned, and has to wash or clean the separated clothing using an additional washing course. In this case, a user suffers substantial inconvenience when using the washing machine because a separate washing operation for some clothing is needed, and the user has to drive the washing machine several times (e.g., twice), so that time and energy may be excessively consumed. Although the user desires to wash or clean a small amount of clothing, if a washing tub is a large-capacity washing tub, the small amount of clothing should be washed or cleaned in the large-capacity washing tub, resulting in unnecessary power consumption.

SUMMARY

Therefore, it is an aspect of the present invention to provide a washing machine having a plurality of washing tubs to clean laundry in different ways classified according to capacity and types of clothing, wherein operations of different washing tubs can be simultaneously stopped or be stopped at different times spaced apart from each other by a predetermined time, although respective washing tubs have different washing conditions (e.g., different input times of clothing, different capacities of clothing, different washing courses, etc.) when laundry is cleaned using all the washing tubs of the washing machine, and a method for controlling the washing machine.

Additional aspects of the invention will be set forth in part in the description which follows and, in part, will be apparent from the description, or may be learned by practice of the invention.

The foregoing and/or other aspects of the present invention are achieved by providing a method of controlling a washing machine having a plurality of washing tubs including determining whether the washing tubs are being operated, and controlling the washing tubs to be simultaneously stopped when the washing tubs are being operated.

The determining whether the washing tubs may be operated includes determining whether each of the washing tubs is performing a washing operation.

The method may further include selecting an optional function for simultaneously stopping operation of the washing tubs.

The simultaneous stopping of the operation of the washing tubs may include controlling operation end times of the washing tubs to be spaced apart from each other by a predetermined time or less.

The method may further include predicting respective operation end times of the washing tubs, wherein the controlling of the washing tubs includes comparing the predicted operation end times of the washing tubs with each other, and controlling the operation times of the washing tubs to simultaneously stop operation of the washing tubs.

The operation end times of the respective washing tubs may be predicted on the basis of respective initially-selected operation courses of the washing tubs.

The controlling of the operation times of the respective washing tubs may include controlling an operation time of one washing tub having a shorter operation end time according to an operation time of the other washing tub having a longer operation end time.

The controlling of the operation times of the respective washing tubs may include increasing an operation time of a corresponding washing tub including controlling an operation function of the washing tub having the shorter operation end time.

The increasing of the operation time of the corresponding washing tub may include adding an operation function to the washing tub having the shorter operation end time according to an operation end time of a counterpart washing tub.

The operation function may include a soaking function, a rinsing standby function, a dehydration standby function, and a cloth-damage prevention function.

The counterpart washing tub may be indicative of the washing tub predicted to have the longer operation end time.

The method may further include generating a washing end sound under a case in which operation end times of the washing tubs are within a predetermined time interval.

The case in which the operation end times of the washing tubs are within the predetermined time interval may include, after controlling one washing tub from among the plurality of washing tubs to stop its operation, controlling the other washing tub to stop its operation within a predetermined time after the operation end time of the one washing tub.

The predetermined time may be about 10 minutes.

The foregoing and/or other aspects of the present invention may be achieved by providing a washing machine including a plurality of washing tubs, an input unit to select an option function to control the washing tubs to simultaneously stop operation, and a controller to determine whether the washing tubs are being operated when the option function is selected through the input unit, and control operation of the respective washing tubs when the washing tubs are being operated such that the washing tubs simultaneously stop respective operations.

The washing tubs may be a first washing tub and a second washing tub, which are vertically arranged and are operated independently of each other.

The first washing tub and the second washing tub may have different capacities.

The controller may predict operation end times of the respective washing tubs, may compare the operation end times of the respective washing tubs with each other, and may control operation times of the respective washing tubs so as to simultaneously stop operation of the washing tubs.

The controller may predict the operation end times of the respective washing tubs on the basis of initially-selected operation courses of the washing tubs.

The controller may control an operation time of one washing tub having a shorter operation end time according to an operation time of the other washing tub having a longer operation end time.

The controller may control the operation time by adding an operation function to the washing tub having the shorter operation end time.

The controller may determine that the washing tubs simultaneously stop operation when the operation end times of the washing tubs are within a predetermined time interval.

The washing machine may further include a sound output unit to generate a washing end sound when the operation end times of the washing tubs are within a predetermined time interval.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION OF EMBODIMENTS

Figure 1:
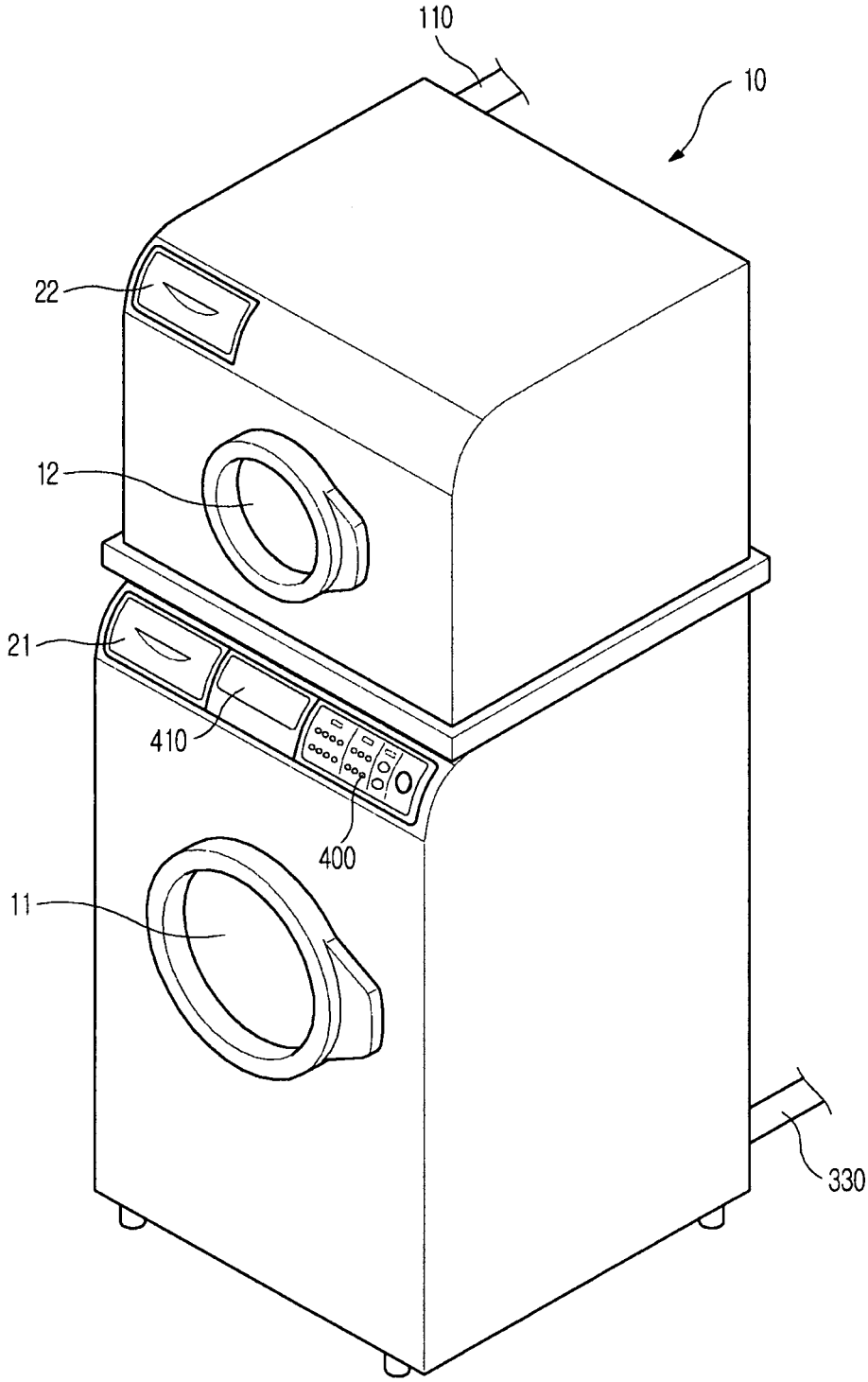
FIG. 1 is a perspective view illustrating the appearance of a washing machine according to an exemplary embodiment.

Reference will now be made in detail to the embodiments, examples of which are illustrated in the accompanying drawings, wherein like reference numerals refer to the like elements throughout. The embodiments are described below to explain the present invention by referring to the figures.

FIG. 1 is a perspective view illustrating the appearance of a washing machine according to an exemplary embodiment.

Referring to FIG. 1, the washing machine 100 includes a plurality of doors 11 and 12 (e.g., two doors) located at upper and lower parts of a main body 10 to form an external appearance thereof, an input unit 400 to enter user commands associated with washing courses and washing machine operations, and a display 410 to display washing courses and operations of the washing machine.

The input unit 400 includes a power button, an operation/stop button to start/stop operation of the washing machine, a washing-tub selection button, and a course-function button. The washing-tub selection button is used to select a washing tub to be used for a simultaneous washing/drying operation or an independent washing/drying operation using a plurality of washing tubs (e.g., two tubs) which can clean laundry in different ways classified according to capacity and types of clothing. The course-function button is used to select a washing course and a washing function of each washing tub. The format of the input unit 400 is not limited to that described above, and may be constructed in other formats as necessary.

First and second detergent providers 21 and 22 to provide a plurality of washing tubs with a detergent are located at the left upper end of the main body 10 and at the left center part of the main body 10, respectively.

Although an embodiment of the present invention discloses first and second detergent providers 21 and 22 to provide a plurality of washing tubs with a detergent, the detergent providers 21 and 22 may be implemented as one detergent provider so that passages of a detergent provided to the washing tubs are separated from each other, and therefore the detergent can be provided to respective washing tubs. The positions of the detergent providers 21 and 22 are not limited to those described above, and may be changed to other positions as necessary.

Figure 2:
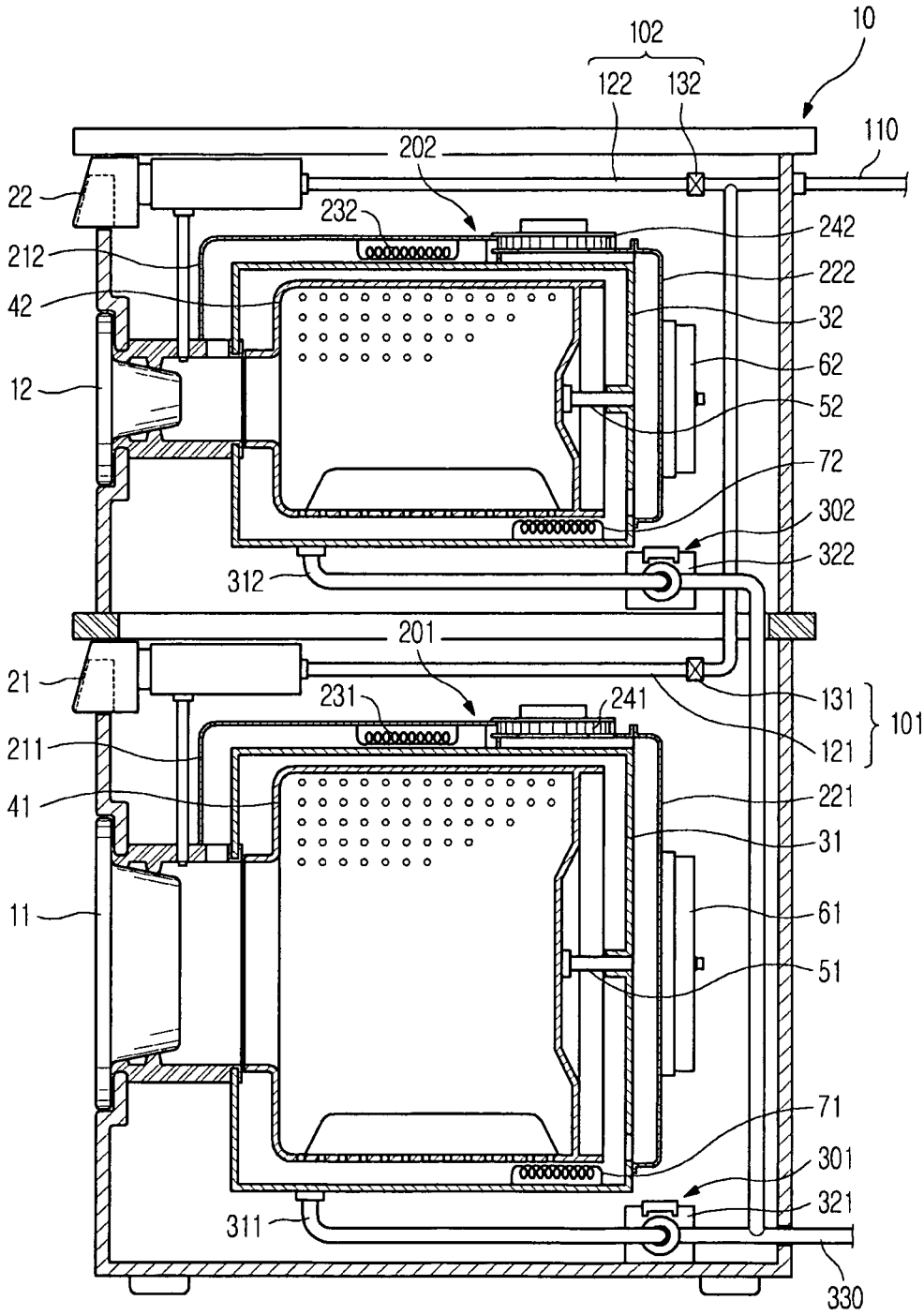
FIG. 2 is a cross-sectional view illustrating a configuration of a washing machine according to an exemplary embodiment.

FIG. 2 is a cross-sectional view illustrating a configuration of a washing machine according to an exemplary embodiment.

Referring to FIG. 2, the main body 10 of the washing machine 100 includes a plurality of lower and upper washing tubs 31 and 32 to classify clothing according to the amount and type of laundry and wash the classified clothing. The lower washing tub 31 is a first washing tub to wash a large amount of laundry (e.g., 13 kg of laundry), and the upper washing tub 32 is a second washing tub to wash a small amount of laundry (e.g., 3 kg of laundry).

The first and second washing tubs 31 and 32 may have the same capacity. The washing tubs may be classified into a large-capacity washing tub and a small-capacity washing tub according to characteristics of the washing machine having several washing tubs 31 and 32. As described above, if a user desires to wash a small amount of laundry (e.g., laundry to be boiled in water), the second washing tub 32 having the small capacity is driven only, to prevent unnecessary power consumption.

A basic configuration of the first washing tub 31 is the same as that of the second washing tub 32. A first cylindrical drum 41 having a plurality of holes is provided in the first washing tub 31 and a second cylindrical drum 42 having a plurality of holes is provided in the second washing tub 32. A first motor 61 used as a driver to rotate a first rotation shaft 51 connected to the first drum 41 to perform washing, rinsing, and dehydration processes is installed at the exterior of the rear part of the first washing tub 31, and a second motor 62 used as a driver to rotate a second rotation shaft 52 connected to the second drum 42 is installed at the exterior of the rear part of the second washing tub 32. The first and second motors 61 and 62 are not limited thereto. If necessary, respective washing tubs 31 and 32 may be simultaneously or independently driven using one motor, a driving belt, a clutch and the like.

A first washing heater 71 to heat water contained in the first washing tub 31 is installed in a lower part of the first washing tub 31, and a second washing heater 72 to heat water contained in the second washing tub 32 is installed at a lower part of the second washing tub 32. A first water-supply unit 101 to provide the first washing tub 31 with water is installed at an upper part of the first washing tub 31, and a second water-supply unit 102 to provide the second washing tub 32 with water is installed at an upper part of the second washing tub 32. The first and second water-supply units 101 and 102 include an external water-supply pipe 110, first and second water-supply pipes 121 and 122, and first and second water-supply valves 131 and 132, respectively. The external water-supply pipe 110 provides the first and second washing tubs 31 and 32 with water (i.e., rinsing or washing water). The first and second water-supply pipes 121 and 122 connect the external water-supply pipe 110 to the first and second detergent providers 21 and 22, respectively. The first and second water-supply valves 131 and 132 to control the supply of water are installed in the middle of the first and second water-supply pipes 121 and 122, respectively. The above-mentioned construction allows water provided in the first and second washing tubs 31 and 32 to pass through the first and second detergent providers 21 and 22, such that the detergent in the first and second detergent providers 21 and 22 along with water can be provided to the first and second washing tubs 31 and 32.

The washing machine further includes first and second drying units 201 and 202 to dry laundry in the first and second washing tubs 31 and 32, respectively. The first and second drying units 201 and 202 include first and second drying ducts 211 and 212, first and second condensing ducts 221 and 222, first and second drying heaters 231 and 232 and first and second drying fans 241 and 242, respectively. The first and second drying ducts 211 and 212 are installed at upper parts of the first and second washing tubs 31 and 32, respectively, to direct hot air to the inside of the first and second washing tubs 31 and 32. The first and second condensing ducts 221 and 222 are installed in the rear parts of the first and second washing tubs 31 and 32, respectively, to remove moist steam. The first and second drying heaters 231 and 232 and the first and second drying fans 241 and 242 are installed in the first and second drying ducts 211 and 212, respectively, to provide hot air.

Although the first and second drying units 201 and 202 to dry laundry are installed in the first and second washing tubs 31 and 32, respectively, the drying units 211 and 212 may also be installed in only one of washing tubs 31 and 32 due to design restrictions of the washing machine.

The washing machine according to an embodiment of the present invention installs first and second drainage units 301 and 302 to drain water of the first and second washing tubs 31 and 32. The first and second drainage units 301 and 302 include first and second drain pipes 311 and 312 and first and second drainage pumps 321 and 322. The first and second drain pipes 311 and 312 are connected to lower parts of the first and second washing tubs 31 and 32 to direct water to the outside of the washing machine, respectively. The first and second drainage pumps 321 and 322 are connected to the first and second drainage pipes 311 and 312. Each of the first and second drainage units 301 and 302 are connected to an external drainage pipe 330.

The first and second drainage pumps 321 and 322 are installed in the first and second washing tubs 31 and 32, respectively, such that water contained in the first and second washing tubs 31 and 32 is drained from the washing machine. A drainage valve is installed in the second washing tub 32 located at an upper part of the washing machine, such that water of the second washing tub 32 can be drained from the washing machine by gravity.

Figure 3:
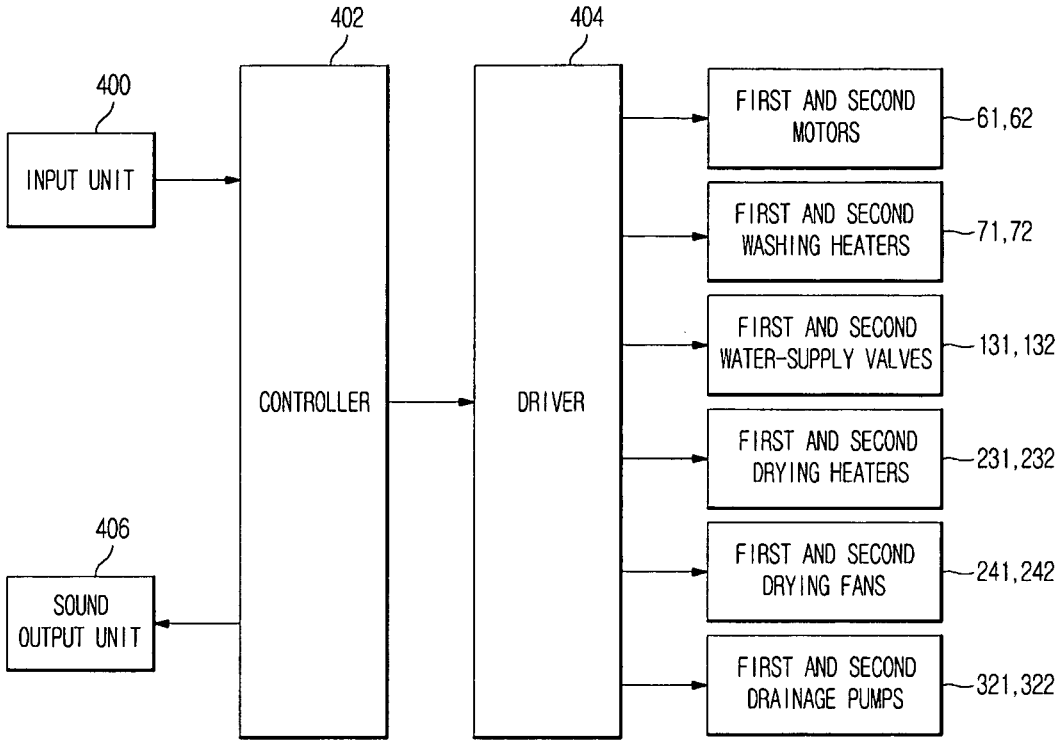
FIG. 3 is a control block diagram illustrating a washing machine according to an exemplary embodiment.

FIG. 3 is a control block diagram illustrating a washing machine according to an exemplary embodiment. The washing machine includes an input unit 400, a controller 402, a driver 404, and a sound output unit 406.

The input unit 400 allows a user to enter operation commands in the controller 402. Here, the operation commands are associated with not only washing courses (e.g., a simultaneous washing/drying course or an independent washing/drying course) of the first and second washing tubs 31 and 32 selected to be simultaneously or independently used, but also washing functions of the tubs 31 and 32. The input unit 400 may further include a simultaneous ending button by which the first and second washing tubs 31 and 32 stop operation when the washing machine cleans laundry using the first and second washing tubs 31 and 32.

There are a variety of exemplary cases in which the washing machine cleans laundry using both the first washing tub 31 and the second washing tub 32. In one exemplary case, laundry is put into the first and second washing tubs 31 and 32 and a washing operation is simultaneously carried out in the first and second washing tubs 31 and 32. In another exemplary case, while laundry is put into either one of the first and second washing tubs 31 and 32 and is then cleaned in the selected tub, other laundry is also put into the other washing tub and is then cleaned in this washing tub. In all cases, if a user presses the simultaneous ending button provided as an option function, the washing machine executes a predetermined algorithm to enable the first and second washing tubs 31 and 32 to simultaneously stop operation irrespective of current progress status information.

The controller 402 is a microprocessor to control overall operations (e.g., washing, rinsing, and dehydration processes) of the first and second washing tubs 31 and 32 according to operation information received from the input unit 400. When the washing operation is carried out using the first and second washing tubs 31 and 32 on the assumption that clothing is put into the first and second washing tubs 31 and 32 at different times, different amounts of laundry are stored in the first and second washing tubs 31 and 32, and different washing courses are executed in the first and second washing tubs 31 and 32, the controller 402 receives a user's request to control the first and second washing tubs 31 and 32 to be simultaneously stopped or be stopped at different times spaced apart from each other by a predetermined time (about 10 minutes) or less by the user's request. The above-mentioned simultaneous ending operation relates to the algorithm executed when the simultaneous ending button is selected through the input unit 400. If necessary, the algorithm may also control the operations of the first and second washing tubs to be stopped at different times spaced apart from each other by a predetermined time when a certain user does not wish to carry out the simultaneous ending function.

When laundry is put into the first and second washing tubs at different times (e.g., in the case where laundry is being cleaned in one washing tub and at the same time other laundry is being cleaned in the other washing tub), washing end times of the first and second washing tubs 31 and 32 become different from each other. In addition, even in the case where different amounts of laundry are provided in the first washing tub 31 and the second washing tub 32 and are subjected to different washing courses, the washing end times of the first and second washing tubs 31 and 32 become different from each other. In this case, a user has to move to the washing machine twice so as to take respective clothing out of the first and second washing tubs, resulting in greater inconvenience. The embodiment of the present invention predicts respective washing end times of the first and second washing tubs 31 and 32 on the basis of an initially-selected washing course when the washing of clothing is carried out in both the first washing tub 31 and the second washing tub 32, and adjusts respective washing durations of the first and second washing tubs 31 and 32 such that the washing end times of the first and second washing tubs 31 and 32 are equal to each other or are spaced apart from each other by a predetermined time (about 10 minutes).

A method to adjust the washing durations of the first and second washing tubs 31 and 32 serves to increase a washing end time of one washing tub 32 or 31 predicted to have a shorter washing end time on the basis of the other washing end time of the other washing tub 31 or 32 predicted to have a longer washing end time. For this operation, the controller 402 compares the predicted washing end times of the first and second washing tubs 31 and 32 with each other, adds washing functions (e.g., a soaking function, a rinsing standby function, a dehydration standby function, a cloth-damage prevention function, etc.) to one washing tub 32 or 31 having the shorter washing end time, and adjusts the washing time of the above washing tub 32 or 31 having the shorter washing end time, such that this adjusted washing tub 32 or 31 stops operation either at a washing end time of the other washing tub 31 or 32 having the longer washing end time or within a predetermined time interval after the lapse of the washing end time of the other washing tub 31 or 32 having the longer washing end time.

Upon receiving a driving control signal from the controller 402, the driver 404 drives first and second motors 61 and 62, first and second washing heaters 71 and 72, first and second water-supply valves 131 and 132, first and second drying heaters 231 and 232, first and second drying fans 241 and 242, first and second drainage pumps 321 and 322, etc.

When a washing operation is executed using the first and second washing tubs 31 and 32, and is then stopped in the first and second washing tubs 31 and 32, the sound output unit 406 controls respective washing end sounds of the first and second washing tubs 31 and 32 to be different from each other according to the sound control signal of the controller 402, such that a user can recognize which one of washing tubs 31 and 32 stops its operation. If the user selects the simultaneous ending button from among option functions, the sound output unit 406 controls only one of the first and second washing tubs 31 and 32 to output one washing end sound at the simultaneous end times of the first and second washing tubs 31 and 32, or outputs a third washing end sound different from the respective washing end sounds of the first and second washing tubs 31 and 32, such that a user can recognize that the first and second washing tubs 31 and 32 stop operations at the same time.

Operations and effects of the above-mentioned washing machine and a control method thereof will hereinafter be described in detail.

Figure 4:
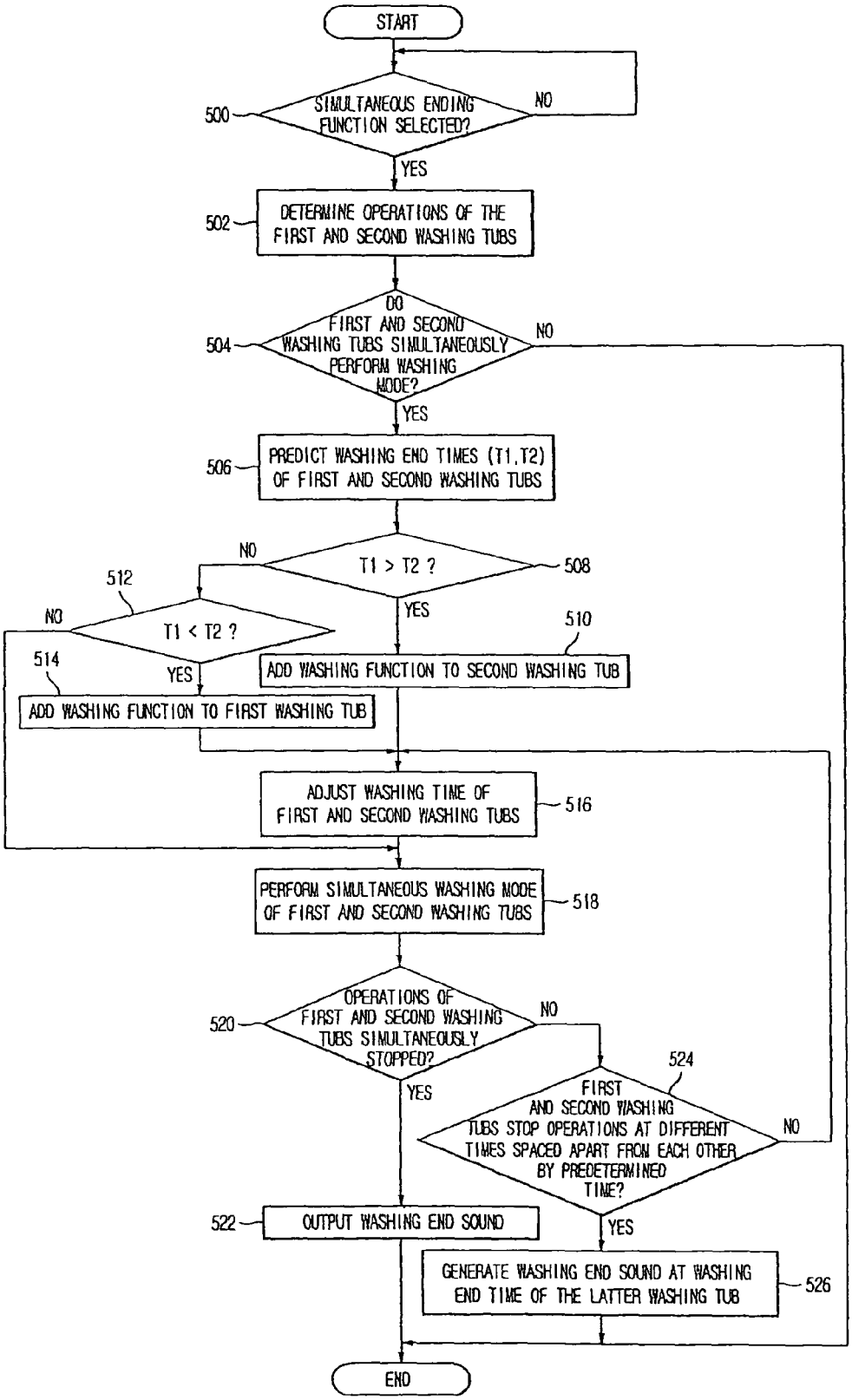
FIG. 4 is a flowchart illustrating a method for controlling a washing machine according to an exemplary embodiment.

FIG. 4 is a flowchart illustrating a method for controlling a washing machine according to an exemplary embodiment. The algorithm shown in FIG. 4 adjusts respective washing times of several washing tubs 31 and 32, such that operation of the washing tubs 31 and 32 is stopped at the same time while laundry classified according to laundry capacities and types are cleaned using both the washing tubs 31 and 32.

The user classifies laundry according to laundry capacities and types, puts the classified laundry in the first and second washing tubs 31 and 32, selects a washing course and function of the respective washing tubs 31 and 32, and then presses the simultaneous ending button. As a result, user-selected operation information is input to the controller 402 through the input unit 400.

Therefore, the controller 402 determines whether the simultaneous ending function is selected according to operation information received from the input unit 400 at operation 500. If the simultaneous ending function is selected, the controller 402 controls the algorithm so that operations of the first and second washing tubs 31 and 32 can be simultaneously stopped.

For this operation, the controller 402 determines operation of the first and second washing tubs 31 and 32 at operation 502, and determines whether the first and second washing tubs 31 and 32 are presently in the simultaneous washing mode at operation 504.

If it is determined that the first and second washing tubs 31 and 32 are in the simultaneous washing mode at operation 504, the controller 402 predicts the washing end times T1 and T2 of the first and second washing tubs 31 and 32 on the basis of initially-selected washing courses of the first and second washing tubs 31 and 32, and compares the washing end times T1 and T2 with each other at operation 506.

Accordingly, the controller 402 compares the first washing end time T1 of the first washing tub 31 with the second washing end time T2 of the second washing tub 32, and determines whether the first washing end time T1 is longer than the second washing end time T2, at operation 508. If the first washing end time T1 of the first washing tub 31 is longer than the second washing end time T2 of the second washing tub 32, the controller 402 adds washing functions (e.g., a soaking function, a rinsing standby function, a dehydration standby function, a cloth-damage prevention function, etc.) to the second washing tub 32 according to the washing end time T1 of the first washing tub 31 having the longer washing end time at operation 510.

If the first washing end time T1 of the first washing tub 31 is not longer than the second washing end time T2 of the second washing tub 32 at operation 508, the controller 402 determines whether the first washing end time T1 of the first washing tub 31 is shorter than the second washing end time T2 of the second washing tub 32 at operation 512.

If the first washing end time T1 of the first washing tub 31 is shorter than the second washing end time T2 of the second washing tub 32 at operation 512, the controller 402 adds a washing function to the first washing tub 31 according to the longer washing end time T2 of the second washing tub 32 at operation 514.

For example, if the first washing end time T1 of the first washing tub 31 is 30 minutes longer than the second washing end time T2 of the second washing tub 32, the soaking function of 10 minutes is added to each of several rinsing processes (e.g., each of three rinsing processes) for the second washing tub 32, so that the washing time of the second washing tub 32 becomes longer. As a result, the washing end time is adjusted to be equal to the washing end time T1 of the first washing tub 31.

In contrast, if the second washing end time T2 of the second washing tub 32 is 30 minutes longer than the first washing end time T1 of the first washing tub 31, the soaking function of 10 minutes is added to each of several rinsing processes (e.g., each of three rinsing processes) for the first washing tub 31, so that the washing time of the first washing tub 31 becomes longer. As a result, the washing end time is adjusted to be the washing end time T2 of the second washing tub 32.

In this way, if the washing times of the first and second washing tubs 31 and 32 are adjusted by adding washing functions to the first and second washing tubs 31 and 32 at operation 516, the first and second washing tubs 31 and 32 simultaneously perform the washing mode according to the adjusted washing times at operation 518.

The above-mentioned operation for controlling the first and second washing tubs 31 and 32 to simultaneously enter the washing mode may be carried out in the same manner as in a series of processes (e.g., a water-supply process, a washing process, a rinsing process, a dehydration process, etc.) executed in one washing tub 31 or 32, and may further include a dehydration process according to a user selection, as necessary.

Thereafter, the controller 402 determines whether all processes of the first and second washing tubs 31 and 32 are stopped at the same time at operation 520. If it is determined that all the processes of the first and second washing tubs 31 and 32 are simultaneously stopped at operation 520, the sound output unit 406 generates the washing end sound to indicate the operation completion of the first and second washing tubs 31 and 32 at operation 522.

In this case, the generated washing end sound may be one of different washing end sounds for the first and second washing tubs 31 and 32, and may also be set to a third washing end sound.

Therefore, the user moves to the washing machine only once so as to take clothing out of the first and second washing tubs 31 and 32, so that the washing machine according to the embodiment can eliminate user inconvenience caused by separate washing operations executed in a conventional washing machine having only one washing tub 31 or 32. Further, since all processes executed in several washing tubs 31 and 32 are simultaneously stopped in the washing machine having several washing tubs 31 and 32, the user need not go to the washing machine several times.

If operation of the first and second washing tubs 31 and 32 is not simultaneously stopped at operation 520, the controller 402 determines whether the washing end times of the first and second washing tubs 31 and 32 are spaced apart from each other by a predetermined time (about 10 minutes) or less at operation 524. If the first and second washing tubs 31 and 32 simultaneously enter the dehydration process, dehydration times of the first and second washing tubs 31 and 32 may be different from each other due to generation of vibration or unbalance. Accordingly, if the washing end time of the first washing tub 31 is spaced apart from the washing end time of the second washing tub 32 by a predetermined time or less, the controller 402 does not generate the washing end sound when either one of the washing tubs 31 and 32 first stops its operation, but generates the above washing end sound at the washing end time of the other washing tub 32 or 31 at operation 526, such that a user can recognize the simultaneous completion of operations of the first and second washing tubs 31 and 32, resulting in increased user satisfaction.

Next, another exemplary case will hereinafter be described with reference to FIG. 5. In this exemplary case, the washing machine generates the washing end sound when the washing operation is carried out using several washing tubs 31 and 32 regardless of whether the user selects the simultaneous ending button from among various option functions.

Figure 5:
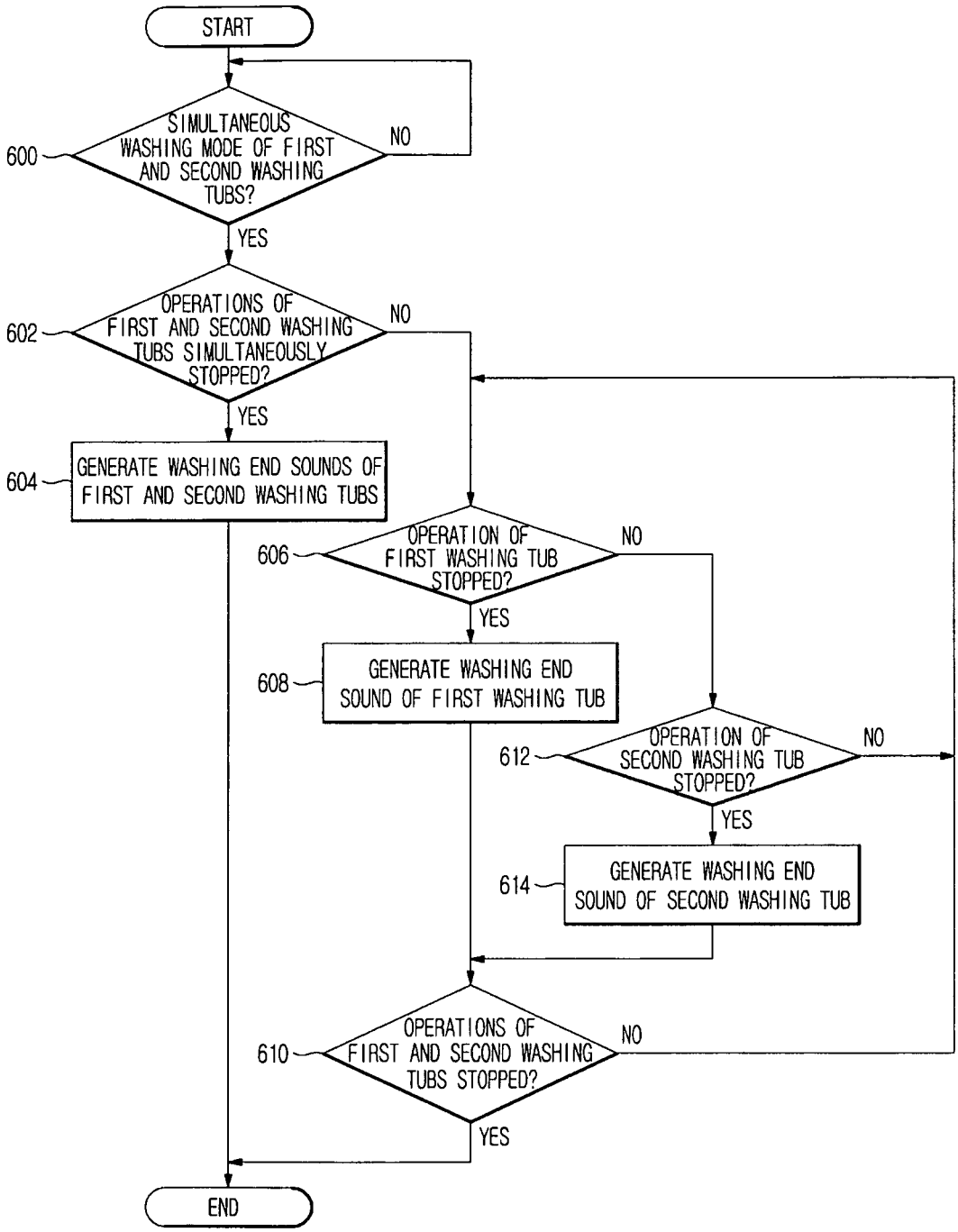
FIG. 5 is a flowchart illustrating a method for controlling a washing end sound of a washing machine according to an exemplary embodiment.

FIG. 5 is a flowchart illustrating a method for controlling a washing end sound of a washing machine according to an exemplary embodiment.

In FIG. 5, the controller 402 determines whether the first and second washing tubs 31 and 32 simultaneously enter the washing mode at operation 600. If it is determined that the first and second washing tubs 31 and 32 simultaneously enter the washing mode at operation 600, the controller 402 determines whether all the processes of the first and second washing tubs 31 and 32 are simultaneously stopped at operation 602.

If the simultaneous completion of operations of the first and second washing tubs 31 and 32 is decided at operation 602, the controller 402 controls the sound output unit 406 to generate the washing end sound so as to indicate the completion of the washing operations of the first and second washing tubs 31 and 32 at operation 604.

In this case, the generated washing end sound may be any one of different washing end sounds of the first and second washing tubs 31 and 32. Furthermore, the sound output unit may generate a third washing end sound as necessary.

If the simultaneous completion of operations of the first and second washing tubs 31 and 32 is not decided at operation 602, the controller 402 determines whether the first washing tub 31 stops its operation at operation 606. If the operation completion of the first washing tub 31 is decided, the sound output unit 406 generates the washing end sound indicating the completion of the washing operation of the first washing tub 31 at operation 608.

Thereafter, the controller 402 determines whether all the processes of the first and second washing tubs 31 and 32 are stopped so that their overall washing operations are also stopped at operation 610. If all operations of the first and second washing tubs 31 and 32 are stopped at operation 610, all operations of the washing machine are terminated. Otherwise, if the first and second washing tubs 31 and 32 stop operations at operation 610, the controller 402 returns to the operation 606 and performs other operations initiated from operation 606.

If the first washing tub 31 does not stop its operation at operation 606, the controller 402 determines whether the second washing tub 32 stops its operation at operation 612. If the operation completion of the second washing tub 32 is not decided, the controller 402 returns to operation 606 and performs other operations initiated from the operation 606.

If the operation of the second washing tub 32 is stopped at operation 612, the sound output unit 406 generates a washing end sound indicating the completion of the washing operation of the second washing tub 32 at operation 614, and goes to operation 601.

As a result, although the user does not select the simultaneous ending button from among option functions, the washing end sound can be generated in the same manner as in the case in which the simultaneous ending button is selected. If either one of the first and second washing tubs 31 and 32 first stops its operation, the washing end sound of the first-stopped washing tub (i.e., the former washing tub) 31 or 32 is generated, so that the user takes laundry out of the former washing tub 31 or 32 and hangs the laundry out to dry. After that, if the latter washing tub 32 or 31 stops its operation after the former washing tub has stopped its operation, another washing end sound different from that of the former washing tub is generated from the latter washing tub, such that the user can take laundry out of the latter washing tub 32 or 31.

In this way, the sound output unit 406 allows the washing end sounds of the first and second washing tubs 31 and 32 to be different from each other, such that respective end times or respective simultaneous end times of the first and second washing tubs 31 and 32 can be easily recognized by the user.

In the meantime, although the embodiments of the present invention have exemplarily disclosed that laundry is simultaneously cleaned in the first and second washing tubs 31 and 32, the scope of the present invention is not limited thereto, and is applicable to other examples as necessary. For example, when laundry is cleaned in either one of the first and second washing tubs 31 and 32, even in the case where a user further puts other laundry in the other washing tub to clean the laundry so that the first and second washing tubs 31 and 32 perform the washing operation, the washing operations of the first and second washing tubs 31 and 32 can be simultaneously stopped by a user's request.

Although the embodiment of the present invention has exemplarily disclosed that the washing operation is carried out using both the first washing tub 31 and the second washing tub 32, the scope of the present invention is not limited thereto, and is applicable to other examples as necessary.

Needless to say, in the case where the first and second washing tubs 31 and 32 are simultaneously used even when a specific operation from among various washing functions capable of being embodied is carried out in the washing machine, operations of the first and second washing tubs 31 and 32 may be simultaneously stopped at a user's request as necessary.

Although the above-mentioned embodiments have exemplarily disclosed the first and second washing tubs 31 and 32 installed in a vertical direction for convenience of description, the scope of the present invention is not limited thereto, and is also applicable to other examples in which the first and second washing tubs 31 and 32 are installed in a horizontal direction.

As is apparent from the above description, the washing machine according to the embodiments of the present invention includes a plurality of washing tubs so as to clean laundry in different ways classified according to amounts and types of clothing. In this case, operations of different washing tubs can be simultaneously stopped or can be stopped at different times spaced apart from each other by a predetermined time, although respective washing tubs have different washing conditions (e.g., different input times of clothing, different amounts of clothing, different washing courses, etc.) when laundry is cleaned using all the washing tubs of the washing machine. As a result, the user need not move to the washing machine several times to take the cleaned laundry out of each washing tub, and the washing time can be effectively reduced and the user need not suffer substantial inconvenience caused by the necessity of the separate washing operation for some clothing when using the washing machine.

The embodiment of the present invention implements the simultaneous ending function of the operations of several washing tubs as an optional function capable of being executed at a user's request, such that a variety of user requests can be reflected in the washing machine shown in the embodiments. If operation end times of several washing tubs are spaced apart from each other by a predetermined time or less due to the occurrence of vibration or unbalance generated by a dehydration process, the washing machine shown in the embodiments is designed to generate only one washing end sound according to the washing end time of the latter washing tub, and achieves the same effect as in the case in which individual operations of several washing tubs are simultaneously stopped, resulting in increased user satisfaction.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for controlling a washing machine having a plurality of washing tubs, comprising:

determining whether the washing tubs are being operated;

controlling the washing tubs to be simultaneously stopped if determined that the washing tubs are being operated; and selecting an optional function for simultaneously stopping operations of the washing tubs, wherein the simultaneous stopping of the operations of the washing tubs includes:

controlling operation end times of the washing tubs to be spaced apart from each other by a predetermined time or less.

2. The method according to claim 1, wherein the determining whether the washing tubs are being operated includes:

determining whether each of the washing tubs is performing a washing operation.

3. The method according to claim 1, further comprising:

generating a washing end sound when the operation end times of the washing tubs are within a predetermined time interval.

4. The method according to claim 3, further comprising:

after controlling one of the washing tubs to stop, controlling the other of the washing tubs to stop operation within a predetermined time after the operation end time of the one washing tub.

5. The method according to claim 4, wherein the predetermined time is about 10 minutes.

6. A method for controlling a washing machine having a plurality of washing tubs, comprising:

determining whether the washing tubs are being operated;

controlling the washing tubs to be simultaneously stopped if determined that the washing tubs are being operated;

selecting an optional function for simultaneously stopping operations of the washing tubs; and predicting respective operation end times of the washing tubs, wherein the controlling of the washing tubs includes comparing the predicted operation end times of the washing tubs with each other, and controlling the operation end times of the washing tubs to simultaneously stop operation of the washing tubs.

7. The method according to claim 6, wherein the operation end times of the respective washing tubs are predicted on the basis of respective initially-selected operation courses of the washing tubs.

8. The method according to claim 7, wherein the controlling of the operation end times of the respective washing tubs includes:

controlling an operation time of one of the washing tubs having a shorter operation end time according to an operation time of the washing tub having a longer operation end time.

9. The method according to claim 8, wherein the controlling of the operation times of the respective washing tubs includes:

increasing an operation time of a corresponding washing tub comprising controlling an operation function of the washing tub having the shorter operation end time.

10. The method according to claim 9, wherein the increasing of the operation time of the corresponding washing tub includes:

adding an operation function to the washing tub having the shorter operation end time according to an operation end time of a counterpart washing tub.

11. The method according to claim 10, wherein the operation function includes a soaking function, a rinsing standby function, a dehydration standby function, and a cloth-damage prevention function.

12. The method according to claim 10, wherein the counterpart washing tub is indicative of the washing tub predicted to have the longer operation end time.

13. The method according to claim 6, wherein the determining whether the washing tubs are being operated includes:

determining whether each of the washing tubs is performing a washing operation.

* * * * *